US010661418B2

(12) United States Patent
Uemura

(10) Patent No.: US 10,661,418 B2
(45) Date of Patent: May 26, 2020

(54) THREADED MEMBER TIGHTENING TOOL AND DRIVE TIME SETTING METHOD FOR THREADED MEMBER TIGHTENING TOOL

(71) Applicant: NITTO KOHKI CO., LTD., Tokyo (JP)

(72) Inventor: Koya Uemura, Tokyo (JP)

(73) Assignee: NITTO KOHKI CO., LTD., Tokyo (JP)

( * ) Notice: Subject to any disclaimer, the term of this patent is extended or adjusted under 35 U.S.C. 154(b) by 219 days.

(21) Appl. No.: 16/002,484

(22) Filed: Jun. 7, 2018

(65) Prior Publication Data

US 2018/0281160 A1 Oct. 4, 2018

Related U.S. Application Data

(63) Continuation of application No. PCT/JP2016/088202, filed on Dec. 21, 2016.

(30) Foreign Application Priority Data

Dec. 25, 2015 (JP) ..... 2015-253608

(51) Int. Cl.
*B25B 23/147* (2006.01)
*B25B 23/14* (2006.01)
*B25B 21/00* (2006.01)

(52) U.S. Cl.
CPC ..... *B25B 23/147* (2013.01); *B25B 21/008* (2013.01); *B25B 23/14* (2013.01)

(58) Field of Classification Search
CPC ... B25B 23/147; B25B 23/1422; B25B 23/14; B25B 21/008; B25B 17/02; B23P 19/06;
(Continued)

(56) References Cited

U.S. PATENT DOCUMENTS 5,154,242 A * 10/1992 Soshin ..... B25B 23/147 173/178
5,315,501 A * 5/1994 Whitehouse ..... B23P 19/066 173/176

(Continued)

FOREIGN PATENT DOCUMENTS

JP S5246600 * 11/1977 ..... G21F 9/30
JP 59-348 1/1984

(Continued)

OTHER PUBLICATIONS

International Search Report dated Mar. 28, 2017 in International (PCT) Application No. PCT/JP2016/088202.

*Primary Examiner* — Hemant Desai
*Assistant Examiner* — Bashir Alsaidi
(74) *Attorney, Agent, or Firm* — Wenderoth, Lind & Ponack, L.L.P.

(57) ABSTRACT

A threaded member tightening tool for setting the length of drive time to elapse before rotation is switched from high-speed rotation to low-speed rotation. A motor-driven screwdriver system in which a screwdriver bit is first driven at a predetermined high rotational speed only for a high-speed drive time and thereafter driven at a predetermined low rotational speed lower than the high rotational speed. A control unit drive-controls an electric motor so that the screwdriver bit is rotationally driven at a setting rotational speed, measures a tightening time required until a Hall element detects that a threaded member engaged with the screwdriver bit has been tightened completely, calculates an initial setting time by multiplying the tightening time by a predetermined positive value less than 1 and a value obtained by dividing the setting rotational speed by the high rotational speed, and sets the high-speed drive time to the initial setting time.

12 Claims, 4 Drawing Sheets

(58) Field of Classification Search
CPC . B23P 19/066; B25C 1/06; B25C 1/08; B25C 1/008; H02P 7/29
USPC ..... 173/176, 6, 179, 180, 181, 15, 2, 4, 5
See application file for complete search history.

(56) References Cited

U.S. PATENT DOCUMENTS

| | | | | |
|---|---|---|---|---|
| 6,516,896 | B1 * | 2/2003 | Bookshar | B23P 9/066 173/1 |
| 10,406,662 | B2 * | 9/2019 | Leh | B25B 23/1475 |
| 2011/0303427 | A1 * | 12/2011 | Tang | B23P 19/066 173/1 |
| 2012/0234566 | A1 * | 9/2012 | Mashiko | B25B 21/02 173/93.5 |
| 2013/0068491 | A1 * | 3/2013 | Kusakawa | B23P 19/066 173/176 |
| 2013/0105189 | A1 * | 5/2013 | Murthy | B25B 21/00 173/178 |
| 2015/0041164 | A1 * | 2/2015 | Sergyeyenko | B25B 21/00 173/1 |
| 2016/0116897 | A1 * | 4/2016 | Ando | B23P 19/066 700/275 |
| 2016/0268873 | A1 * | 9/2016 | Ikeda | H02K 7/145 |
| 2016/0318164 | A1 * | 11/2016 | Baker | B23P 19/066 |
| 2018/0200872 | A1 * | 7/2018 | Leong | B25B 21/002 |

FOREIGN PATENT DOCUMENTS

| | | |
|---|---|---|
| JP | 61-86142 | 5/1986 |
| JP | 7-124827 | 5/1995 |
| JP | 7-186063 | 7/1995 |
| JP | 2000-176850 | 6/2000 |
| JP | 3992676 | 8/2007 |
| JP | 2012-200809 | 10/2012 |
| WO | 2008/093418 | 8/2008 |

* cited by examiner

THREADED MEMBER TIGHTENING TOOL AND DRIVE TIME SETTING METHOD FOR THREADED MEMBER TIGHTENING TOOL

TECHNICAL FIELD

The present invention relates to a threaded member tightening tool for tightening threaded members such as screws and nuts, and also relates to a drive time setting method for the threaded member tightening tool.

BACKGROUND ART

There is known a threaded member tightening tool for tightening threaded members, e.g. screws and nuts, which is configured to adjust the threaded member tightening torque to an appropriate magnitude.

A tool disclosed in Patent Literature 1, for example, has a mechanical clutch mechanism to perform a torque adjustment with the clutch mechanism. Specifically, when a torque greater than a predetermined value is applied to the clutch mechanism after a threaded member has been seated, the clutch mechanism is activated to cancel the mechanical connection between a motor and a threaded member engaging unit, e.g., a screwdriver bit, so that a torque greater than the predetermined value will not be applied to the threaded member.

A threaded member tightening tool using the above-described clutch mechanism is likely to become large in size and heavy in weight due to having a mechanical structure constituting the clutch mechanism. Accordingly, there has also been developed a threaded member tightening tool that is not provided with a mechanical clutch mechanism but, instead, configured to adjust the torque when a threaded member has been seated by electrically detecting the torque applied to the motor by using an electric current sensor detecting an electric current flowing through the motor, or using a torque sensor, in order to make the tool compact in size and light in weight. In such a tool, the drive of the motor is stopped upon detecting the completion of tightening of a threaded member by electrically detecting the torque. In this regard, however, inertia force acting on the motor, a speed reducer, etc. is borne by the threaded member. Therefore, an excessive force may be applied to the threaded member, which may cause breakage of the threaded member or an object to be fastened with the threaded member. Accordingly, another conventional threaded member tightening tool is configured as shown in Patent Literature 2, for example. That is, screw tightening is started at a relatively high rotational drive speed at first, and before the threaded member is seated, the rotational speed is reduced to a speed at which no excessive torque will be applied to the threaded member. Thereafter, the threaded member is tightened completely.

CITATION LIST

Patent Literature

Patent Literature 1: Japanese Patent No. 3992676

Patent Literature 2: Japanese Examined Patent Publication No. Sho 59-348

SUMMARY OF INVENTION

Technical Problem

In a threaded member tightening tool wherein the tightening tool is rotationally driven at a relatively high speed at first, and before the threaded member is seated, the rotational drive speed is reduced, as shown in Patent Literature 2, setting of the length of drive time to elapse before the rotational speed is changed is usually made based on the operator's intuitive judgment. If the length of drive time to elapse before the rotational speed is changed is set excessively long, the threaded member may be seated in a state where the tightening tool is being rotationally driven at high speed, causing breakage of the threaded member, etc. Therefore, setting of the drive time needs to be made carefully. If the drive time is set excessively short, the time required to complete tightening of the threaded member increases, causing degradation of work efficiency. Therefore, in order to set the length of drive time to elapse before the rotational speed is changed to an appropriate length of time, it is necessary to perform setting of a rotational speed change time by repeating a tightening operation many times using screws for testing or the like before performing an actual tightening operation for products or the like. Such drive time setting needs to be performed every time the type of threaded members changes, which is troublesome.

Accordingly, the present invention provides a threaded member tightening tool capable of simply and easily setting the length of drive time to elapse before rotation is switched from high-speed rotation to low-speed rotation, and also provides a drive time setting method for the threaded member tightening tool.

Solution to Problem

The present invention provides a threaded member tightening tool including the following elements: an electric motor for rotationally driving a threaded member engaging unit engageable with a threaded member; a control unit drive-controlling the electric motor; and a tightening detecting unit detecting that a threaded member has been tightened to an object to be fastened. The control unit is configured to control the electric motor so that the threaded member engaging unit is first rotationally driven at a predetermined high rotational speed only for a high-speed drive time and thereafter rotationally driven at a predetermined low rotational speed lower than the high rotational speed. The control unit drive-controls the electric motor so that the threaded member engaging unit is rotationally driven at a setting rotational speed, and measures a tightening time required until the tightening detecting unit detects that a threaded member engaged with the threaded member engaging unit has been tightened to an object to be fastened. Further, the control unit calculates an initial setting time by multiplying the tightening time by a predetermined positive value less than 1 and a value obtained by dividing the setting rotational speed by the high rotational speed, and sets the high-speed drive time to the initial setting time.

The threaded member tightening tool is configured to measure a threaded member tightening time when the threaded member engaging unit is rotationally driven at a setting rotational speed, to obtain an initial setting time by multiplying the tightening time by a predetermined positive value less than 1 and a value obtained by dividing the setting rotational speed by the high rotational speed, and to set the high-speed drive time to the initial setting time thus obtained. The high-speed drive time set in this way is shorter than a time required for tightening the same threaded member to the object to be fastened when the threaded member is threadedly engaged at the high rotational speed. Therefore, there is basically no possibility of the threaded member being tightened to the object to be fastened in a state where the threaded member engaging unit is being rotationally driven at the high rotational speed when a threaded member tightening operation is performed with the high-speed drive time set as stated above. With the threaded member tightening tool, an appropriate high-speed drive time can be automatically set by once performing a tightening operation at the setting rotational speed. Accordingly, it is unnecessary to perform such a troublesome operation that the operator performs time setting by repeating a tightening operation using threaded members for testing as in the conventional technique.

Preferably, the arrangement may be as follows. The threaded member tightening tool further includes an operation input device transmitting a setting time changing signal to the control unit. The control unit is configured to calculate, when receiving the setting time changing signal, a first resetting time by adding or subtracting a predetermined adjusting time to or from the high-speed drive time, and to reset the high-speed drive time to the first resetting time.

Alternatively, the arrangement may be as follows. The threaded member tightening tool further includes an operation input device transmitting a setting time changing signal to the control unit. The control unit is configured to calculate, when receiving the setting time changing signal, a first resetting time by increasing or decreasing the high-speed drive time by an amount corresponding to a predetermined proportion of the high-speed drive time, and to reset the high-speed drive time to the first resetting time.

Alternatively, the arrangement may be as follows. The control unit measures a low-speed drive time required from when the high-speed drive time has elapsed until the tightening detecting unit detects that a threaded member has been tightened to an object to be fastened, calculates a first resetting time by adding or subtracting an adjusting time to or from the high-speed drive time, the adjusting time being obtained by multiplying the low-speed drive time by a predetermined positive value less than 1 and a value obtained by dividing the low rotational speed by the high rotational speed, and resets the high-speed drive time to the first resetting time.

Threaded members such as screws and nuts have some dimensional errors. Therefore, even with threaded members of the same type, the drive time required for tightening, strictly speaking, differs for each threaded member. The required drive time also differs depending on how threaded members are initially placed on an object to be fastened, and due to variations in rotational speed, acceleration and deceleration of the electric motor, etc. Accordingly, there may be occasions when the high-speed drive time set on the basis of the initial setting time obtained by the above-described calculation is not necessarily an optimal time. On such an occasion, the high-speed drive time is reset to the above-described first resetting time, thereby enabling the high-speed drive time to be set to an even more optimal time while performing a threaded member tightening operation.

Preferably, the control unit may be configured to calculate a second resetting time by subtracting a predetermined adjusting time from the high-speed drive time when the tightening detecting unit detects that a threaded member has been tightened to an object to be fastened before the high-speed drive time has elapsed, and to reset the high-speed drive time to the second resetting time.

Alternatively, the control unit may be configured to, when the tightening detecting unit detects that a threaded member has been tightened to an object to be fastened before the high-speed drive time has elapsed, calculate a second resetting time by multiplying the high-speed drive time by a predetermined positive value less than 1, and to reset the high-speed drive time to the second resetting time.

With the above-described arrangement, it is possible to automatically correct such an inappropriate situation where a threaded member is undesirably tightened to an object to be fastened during the rotation at the high rotational speed.

In addition, the present invention provides a drive time setting method of setting a high-speed drive time for a threaded member tightening tool, the threaded member tightening tool having an electric motor for rotationally driving a threaded member engaging unit engageable with a threaded member, and a control unit drive-controlling the electric motor, the control unit being configured to control the electric motor so that the threaded member engaging unit is first rotationally driven at a predetermined high rotational speed only for a high-speed drive time and thereafter rotationally driven at a predetermined low rotational speed lower than the high rotational speed. The drive time setting method includes the following steps: the step of rotationally driving the threaded member engaging unit at a setting rotational speed and of measuring a tightening time required until a threaded member engaged with the threaded member engaging unit has been tightened to an object to be fastened; the step of calculating an initial setting time by multiplying the tightening time by a predetermined positive value less than 1 and a value obtained by dividing the setting rotational speed by the high rotational speed; and the step of setting the high-speed drive time to the initial setting time.

The drive time setting method is configured to measure a threaded member tightening time when the threaded member engaging unit is rotationally driven at a setting rotational speed, to obtain an initial setting time by multiplying the tightening time by a predetermined positive value less than 1 and a value obtained by dividing the setting rotational speed by the high rotational speed, and to set the high-speed drive time to the initial setting time thus obtained. The high-speed drive time set in this way is shorter than a time required for tightening the threaded member to the object to be fastened when the threaded member is threadedly engaged at the high rotational speed. Therefore, there is basically no possibility of the threaded member being tightened to the object to be fastened in a state where the threaded member engaging unit is being rotationally driven at the high rotational speed when a threaded member tightening operation is performed with the high-speed drive time set as stated above. With the drive time setting method, an appropriate high-speed drive time can be readily set based on a tightening time measured by once performing a tightening operation at the setting rotational speed. Accordingly, it is unnecessary to perform such a troublesome operation that the operator performs time setting by repeating a tightening operation using threaded members for testing as in the conventional technique.

Preferably, the drive time setting method may further include, following the step of setting the high-speed drive time to the initial setting time, the step of calculating a first resetting time by adding or subtracting a predetermined adjusting time to or from the high-speed drive time, and the step of resetting the high-speed drive time to the first resetting time.

Alternatively, the drive time setting method may further include, following the step of setting the high-speed drive time to the initial setting time, the step of calculating a first resetting time by increasing or decreasing the high-speed drive time by an amount corresponding to a predetermined proportion of the high-speed drive time, and the step of resetting the high-speed drive time to the first resetting time.

Alternatively, the drive time setting method may further include, following the step of setting the high-speed drive time to the initial setting time, the step of, while performing a threaded member tightening operation with the threaded member tightening tool, measuring a low-speed drive time required from when the high-speed drive time has elapsed until a threaded member has been tightened to an object to be fastened, the step of calculating a first resetting time by adding or subtracting an adjusting time to or from the high-speed drive time, the adjusting time being obtained by multiplying the low-speed drive time by a predetermined positive value less than 1 and a value obtained by dividing the low rotational speed by the high rotational speed, and the step of resetting the high-speed drive time to the first resetting time.

There may be occasions when the high-speed drive time set on the basis of the initial setting time obtained by the above-described calculation is not necessarily an optimal time. On such an occasion, the high-speed drive time is reset to the above-described first resetting time, thereby enabling the high-speed drive time to be set to an even more optimal time while performing a threaded member tightening operation.

Preferably, the drive time setting method may further include the step of, when a threaded member has been tightened to an object to be fastened before the high-speed drive time has elapsed during a threaded member tightening operation performed with the threaded member tightening tool, calculating a second resetting time by subtracting a predetermined adjusting time from the high-speed drive time, and the step of resetting the high-speed drive time to the second resetting time.

Alternatively, the drive time setting method may further include the step of, when a threaded member has been tightened to an object to be fastened before the high-speed drive time has elapsed during a threaded member tightening operation performed with the threaded member tightening tool, calculating a second resetting time by multiplying the high-speed drive time by a predetermined positive value less than 1; and the step of resetting the high-speed drive time to the second resetting time.

With the above-described method, it is possible to automatically correct such an inappropriate situation where a threaded member is undesirably tightened to an object to be fastened during rotation at the high rotational speed.

Embodiments of a threaded member tightening tool and drive time setting method according to the present invention will be explained below on the basis of the accompanying drawings.

DESCRIPTION OF EMBODIMENTS

Figure 1:
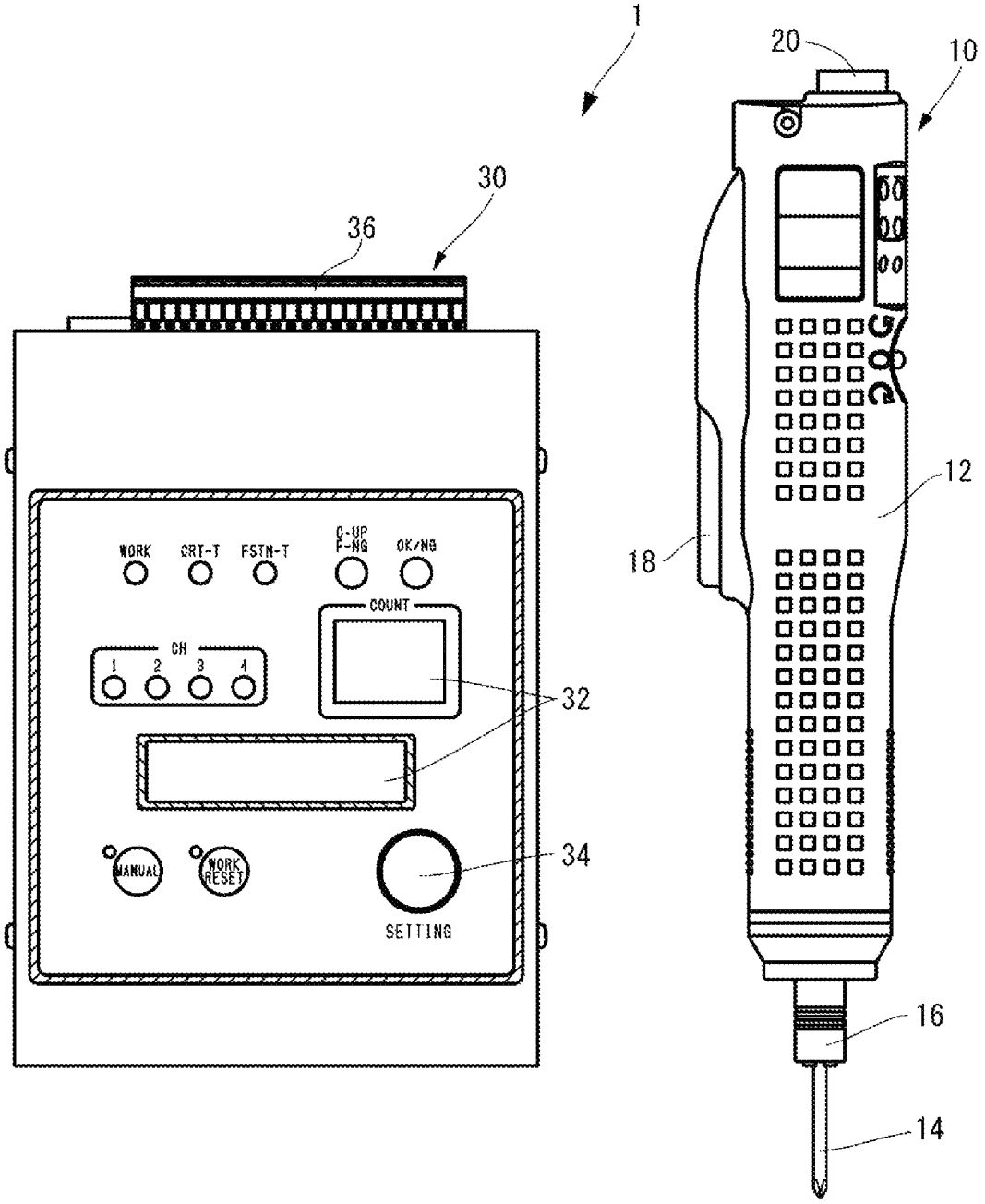
FIG. 1 is an illustration showing a motor-driven screwdriver system according to one embodiment of the present invention.
Figure 2:
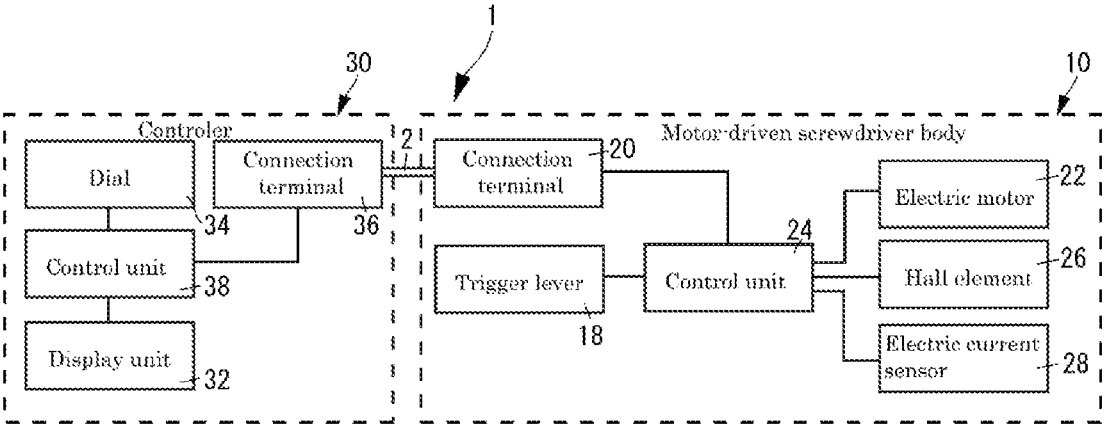
FIG. 2 is a functional block diagram of the motor-driven screwdriver system shown in FIG. 1.

A motor-driven screwdriver system 1 according to one embodiment of the threaded member tightening tool of the present invention comprises, as shown in FIGS. 1 and 2, a motor-driven screwdriver body 10 and a controller 30. The motor-driven screwdriver body 10 and the controller 30 are connected through a cable 2 (not shown in FIG. 1) so that various signals can be communicated therebetween.

The motor-driven screwdriver body 10 has a housing 12, a screwdriver bit (threaded member engaging unit) 14 engageable with a screw (threaded member), a bit holder 16 detachably and securely holding the screwdriver bit 14, a trigger lever 18 actuated to start and stop the drive of the bit holder 16, and a connection terminal 20 to which the above-described cable 2 is connected.

The controller 30 is provided with a display unit 32 for showing various statuses of the motor-driven screwdriver body 10 and, in addition thereto, a dial 34 as an operation input device for setting various settings for the motor-driven screwdriver body. Further, the controller 30 is provided with a connection terminal 36 to which the above-described cable 2 is connected. The controller 30 further has therein a control unit 38 controlling the output to the display unit 32 and the input from the dial 34 and further controlling the communication between the controller 30 and the motor-driven screwdriver body 10. The dial 34 has an incremental rotary encoder and is configured to give a click feeling to the operator every time he or she rotates the dial 34 through a predetermined angle (20 degrees) and to transmit an A-phase pulse signal and a B-phase pulse signal to the control unit 38 each time the dial 34 is rotated through the predetermined angle. Further, the dial 34 is capable of being depressed. If the dial 34 is depressed long for one second, the motor-driven screwdriver system 1 shifts from a drive mode to a setting mode, and a setting item is displayed on the display unit 32. The displayed item is changed by rotating the dial 34, and if the dial 34 is depressed for a short time (less than one second) when an item to which the operator wants to make a change is being displayed, the system is brought into a state where a change can be made to the item concerned. If the dial 34 is rotated in this state, the setting value of the item can be changed. If the dial 34 is depressed for a short time again after the setting of the item has been changed to desired one, the selected setting is determined. If the dial 34 is depressed for a long time after all settings have been completed, the setting mode is completed, and the motor-driven screwdriver system 1 returns to the drive mode.

As shown in FIG. 2, the housing 12 of the motor-driven screwdriver body 10 is provided therein with an electric motor 22 for rotationally driving the bit holder 16 and the screwdriver bit 14, a control unit 24 performing control of the electric motor 22, etc., a Hall element 26 for detecting the rotational state of the electric motor 22, and an electric current sensor 28 for detecting an electric current flowing through the electric motor 22. The torque applied to the electric motor 22 can be measured by measuring the magnitude of electric current flowing through the electric motor 22.

Figure 3:
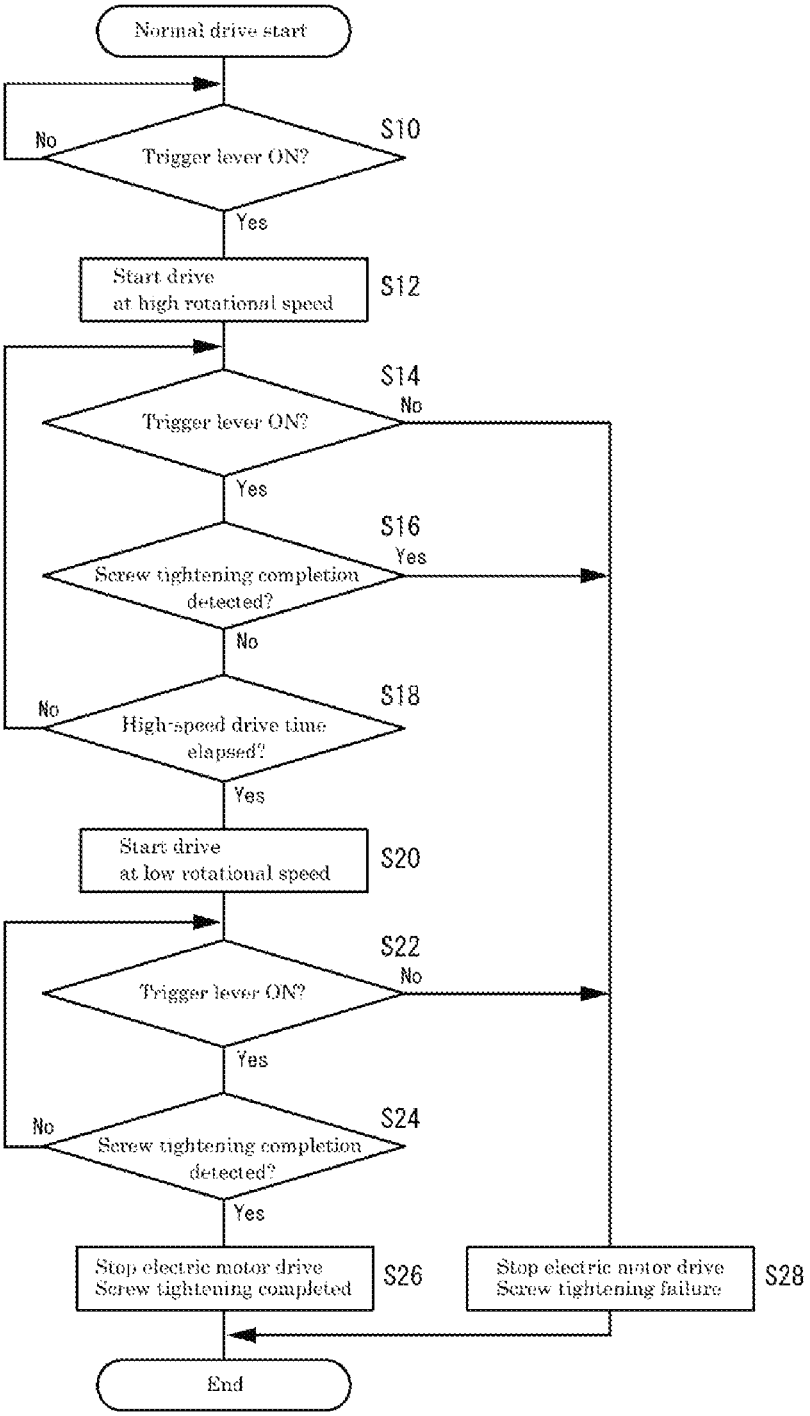
FIG. 3 is a flowchart showing the operation of the motor-driven screwdriver system shown in FIG. 1 when the system is in a normal drive mode.

The motor-driven screwdriver system 1 is configured as follows. As shown in the flowchart of FIG. 3, when the trigger lever 18 is actuated to the "on" state, the screwdriver bit 14 is first rotationally driven at a predetermined high rotational speed (e.g. 500 rpm), and when a predetermined high-speed drive time has elapsed from the start of the drive, the screwdriver bit 14 is rotationally driven with the rotational speed reduced to a low rotational speed (e.g. 100 rpm). Specifically, when the trigger lever 18 is actuated to the "on" state (S10), the control unit 24 starts the drive of the electric motor 22. At this time, the electric motor 22 is controlled by the control unit 24 so that the screwdriver bit 14 rotates at a preset high rotational speed (S12). It should be noted that the rotational speed of the electric motor 22 is measured by the Hall element 26. The rotational drive of the screwdriver bit 14 at the high rotational speed is continued until a high-speed drive time set by the later-described method has elapsed (S18). If the "on" state of the trigger lever 18 is canceled (S14) or it is detected that the screw has been seated and tightened (S16) before the high-speed drive time has elapsed, it is judged that screw tightening has not been completed normally, and the control unit 24 stops the drive of the electric motor 22 (S28). When the high-speed drive time has elapsed (S18), the control unit 24 controls the drive of the electric motor 22 so that the screwdriver bit 14 is rotationally driven at a preset low rotational speed (S20). The rotational drive of the screwdriver bit 14 at the low rotational speed is continued until it is detected that the screw has been seated and tightened (S24). If the "on" state of the trigger lever 18 is canceled before it is detected that the screw has been tightened completely (S22), it is judged that the screw tightening has not been completed normally, and the control unit 24 stops the drive of the electric motor 22 (S28). When it is detected that the screw has been tightened during the drive at the low rotational speed (S24), it is judged that screw tightening has been completed normally, and the control unit 24 stops the drive of the electric motor 22 (S26). It should be noted that the detection of whether or not the screw has been tightened completely is performed by using the Hall element 26 or the electric current sensor 28. That is, when the screw has been tightened completely, the screwdriver bit 14 cannot further rotate, and consequently, the rotation of the electric motor 22 stops. Therefore, it is possible to judge that the screw has been tightened completely by detecting the rotation stop state of the electric motor 22 with the Hall element 26. It is also possible to judge that the screw has been tightened completely by measuring the magnitude of electric current flowing through the electric motor 22 with the electric current sensor 28 because a large electric current flows through the electric motor 22 when the rotation of the electric motor 22 stops. It should be noted that a torque sensor may be provided as a tightening detecting unit in place of the Hall element 26 or the electric current sensor 28 to measure the torque applied to the screwdriver bit 14 or the electric motor 22 and to detect whether or not the screw has been tightened completely based on the magnitude of the measured torque.

The motor-driven screwdriver system 1 is configured to perform screw tightening by rotationally driving the screwdriver bit 14 at a predetermined high rotational speed only for a high-speed drive time and thereafter rotationally driving the screwdriver bit 14 at a low rotational speed, as has been stated above. That is, first, a screw is tightened rapidly at a high rotational speed within a range in which the screw is not seated, and then the rotational speed is reduced to a low rotational speed at which no excessive torque will be applied to the screw and the object to be fastened therewith when the screw is tightened to the to-be-fastened object. Thereafter, the screw is seated and tightened to the to-be-fastened object. When the screw is seated and tightened, the rotation of the screwdriver bit 14 and the electric motor 22 is decelerated rapidly; therefore, the screw receives inertia force from the screwdriver bit 14, the electric motor 22, etc. If the rotational speed when the screw is seating onto the to-be-fastened object is excessively high, the screw and the to-be-fastened object are subjected to an excessive force and may be broken. Therefore, the low rotational speed is set to a speed at which an appropriate torque will be loaded onto the screw, etc. Further, if the screw is tightened to the to-be-fastened object while the screwdriver bit 14 is being rotationally driven at the high rotational speed, the screw, etc. may be broken. Therefore, the high-speed drive time needs to be set carefully so that the screw will not be seated while the screwdriver bit 14 is being rotationally driven at the high rotational speed.

Figure 4:
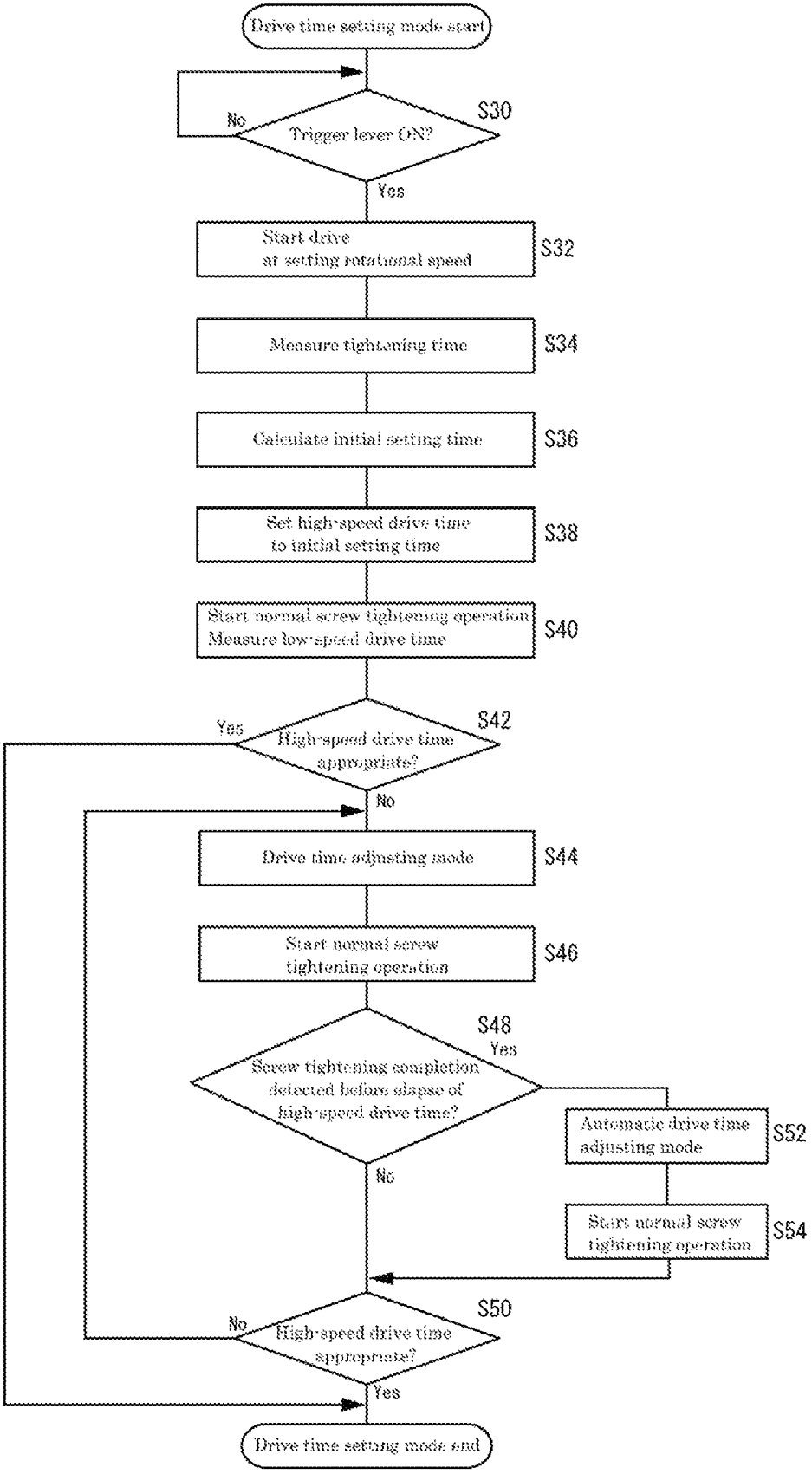
FIG. 4 is a flowchart showing the operation of the motor-driven screwdriver system shown in FIG. 1 when the system is in a drive time setting mode.

With the motor-driven screwdriver system 1, the high-speed drive time is set as shown in the flowchart of FIG. 4. First, the motor-driven screwdriver system 1 is switched to a drive time setting mode, which is one of setting modes, from the normal drive mode by properly actuating the dial 34, and in this state, the trigger lever 18 is turned on to start a screw tightening operation (S30). At this time, the control unit 24 controls the electric motor 22 so that the screwdriver bit 14 is rotationally driven at a predetermined setting rotational speed (e.g. 100 rpm) (S32) and measures the length of tightening time required until it is detected that a screw has been tightened to a to-be-fastened object by the Hall element 26 or the electric current sensor 28 as a tightening detecting unit (S34). When it is detected that the screw has been tightened to the to-be-fastened object, the drive of the electric motor 22 is stopped, and the control unit 24 calculates an initial setting time based on the measured tightening time (S36). Specifically, the initial setting time is calculated from the following formula:

[Formula 1]

$$\text{Initial setting time} = \text{tightening time} \times \frac{\text{setting rotational speed}}{\text{high rotational speed}} \times \text{arbitrary constant} \quad (1)$$

Let us assume, for example, that the tightening time is 3 seconds, the setting rotational speed is 100 rpm, the high rotational speed is 500 rpm, and the arbitrary constant (positive number less than 1) is 0.5. In this case, the initial setting time obtained from the above formula (1) is 0.3 seconds. The control unit 24 sets the high-speed drive time to the initial setting time (0.3 seconds) (S38).

Next, a screw tightening operation is performed in accordance with the normal screw tightening operation shown in the flowchart of FIG. 3 (S40, S10 to S28). At this time, the control unit 24 measures the length of time required from when the high-speed drive time has elapsed until it is detected that the screw has been tightened to the to-be-fastened object, i.e. the length of low-speed drive time during which the tool is driven at the low rotational speed (S40). The operator who performed the screw tightening operation judges whether or not the high-speed drive time is appropriate (S42). If the high-speed drive time is judged to be appropriate, the operator ends the drive time setting mode by properly actuating the controller 30. If the high-speed drive time is judged to be not appropriate, the operator shifts to a drive time adjusting mode by properly actuating the controller 30 (S44).

The drive time adjusting mode includes a first to third modes in which the high-speed drive time is adjusted manually with the dial 34 of the controller 30, and a fourth mode in which the high-speed drive time is adjusted automatically through calculation by the control unit 24. One of these four modes can be selected and set at will in advance of shifting to the drive time adjusting mode. In the first mode, the control unit 24 receives a setting time changing signal transmitted from the dial 34 every time the dial 34 is rotated through a predetermined angle (20 degrees), calculates a resetting time (first resetting time) by adding or subtracting 10 ms to or from the high-speed drive time every time the dial 34 is rotated through the predetermined angle, and resets the high-speed drive time to the resetting time thus calculated. Specifically, if the dial 34 is rotated clockwise through 20 degrees, 10 ms is added to 0.3 s, which is the high-speed drive time set at step S38, to obtain a resetting time of 0.31 s, and the high-speed drive time is reset to the resetting time of 0.31 s. If the dial 34 is rotated counterclockwise through 40 degrees, 20 ms is subtracted from 0.3 s to obtain a resetting time of 0.28 s, and the high-speed drive time is reset to 0.28 s. In the second mode, a resetting time is calculated by increasing or decreasing the high-speed drive time by an amount corresponding to an arbitrarily predetermined proportion of the high-speed drive time in accordance with the amount of rotation of the dial 34, and the high-speed drive time is reset to the resetting time. Specifically, in a case where the predetermined proportion has been set to be 10%, for example, if the dial 34 is rotated clockwise through 20 degrees, 30 ms, which is 10% of the already set high-speed drive time, i.e. 0.3 s, is added to 0.3 s to obtain a resetting time of 0.33 s, and the high-speed drive time is reset to 0.33 s. If the dial 34 is rotated counterclockwise through 40 degrees, 60 ms, which is 20% of 0.3 s, is subtracted from 0.3 s to obtain a resetting time of 0.24 s, and the high-speed drive time is reset to 0.24 s. In the third mode, the control unit 24 calculates a resetting time by adding or subtracting an adjusting time arbitrarily set per predetermined angle of the dial 34 in accordance with the amount of rotation of the dial 34, and resets the high-speed drive time to the resetting time thus calculated. In the first mode, the adjusting time is fixed at 10 ms and cannot be changed; in the third mode, the adjusting time can be set arbitrarily. In the fourth mode, the control unit 24 calculates an adjusting time based on the low-speed drive time, which has already been measured at S40. Specifically, the resetting time is calculated from the following formula:

[Formula 2]

$$\text{Adjusting time} = \text{low-speed drive time} \times \frac{\text{low rotational speed}}{\text{high rotational speed}} \times \text{arbitrary constant} \quad (2)$$

Let us assume, for example, that the low-speed drive time is 0.3 s, the low rotational speed is 100 rpm, the high rotational speed is 500 rpm, and the arbitrary constant (positive number less than 1) is 0.2. In this case, the adjusting time obtained from the above formula (2) is 12 ms. The control unit 24 adds the adjusting time to the high-speed drive time, which has already been set, to obtain a resetting time (0.312 s), and resets the high-speed drive time to the resetting time thus obtained. It should be noted that the fourth mode may also be configured to allow selection of whether to add or subtract the adjusting time to or from the high-speed drive time to obtain a resetting time.

Upon completion of resetting the high-speed drive time in the drive time adjusting mode, a screw tightening operation is then performed in accordance with the normal screw tightening operation shown in the flowchart of FIG. 3 (S46, S10 to S28). When screw tightening has been completed appropriately in the screw tightening operation, i.e. when it is detected that the screw has been seated and tightened during the drive at the low rotational speed after the elapse of the high-speed drive time (S48), the operator who performed the screw tightening operation judges whether or not the reset high-speed drive time is appropriate (S50). If the reset high-speed drive time is judged to be appropriate, the operator ends the drive time setting mode by properly actuating the controller 30. If the reset high-speed drive time is judged to be not appropriate, the operator shifts to the drive time setting mode again by properly actuating the controller 30 (S44). In the screw tightening operation at S46, the low-speed drive time is not measured. Therefore, the fourth mode cannot be selected in the drive time adjusting mode carried out thereafter. The operator is obliged to select one of the first to third modes. If it is detected that a screw has been tightened to a to-be-fastened object before the high-speed drive time has elapsed in the normal screw tightening operation at S46 (S48), the mode is shifted to an automatic drive time adjusting mode (S52).

The automatic drive time adjusting mode includes two modes, which are selectable at will. In a first mode, a resetting time (second resetting time) is calculated by subtracting a predetermined adjusting time (e.g. 10 ms) from a high-speed drive time (e.g. 0.33 s), and the high-speed drive time is reset to the resetting time (0.32 s). In a second mode, a high-speed drive time (e.g. 0.33 s) is multiplied by an arbitrary constant which is a positive number less than 1 (e.g. 0.95) to calculate a resetting time (0.3135 s), and the high-speed drive time is reset to the resetting time (0.3135 s). Upon completion of the resetting, the normal screw tightening operation shown in the flowchart of FIG. 3 is performed again (S54, S10 to S28), and the operator who performed the screw tightening operation judges whether or not the reset high-speed drive time is appropriate (S50). If the reset high-speed drive time is judged to be appropriate, the operator ends the drive time setting mode by properly actuating the controller 30. If the reset high-speed drive time is judged to be not appropriate, the operator shifts to the drive time adjusting mode again by properly actuating the controller 30 (S44). In the screw tightening operation at S54, the low-speed drive time is not measured. Therefore, the fourth mode cannot be selected in the drive time adjusting mode carried out thereafter. The operator is obliged to select one of the first to third modes. It should be noted that the system may be set such that even if it is detected that a screw has been tightened to a to-be-fastened object before the high-speed drive time has elapsed in the normal screw tightening operation at S44, the mode is not shifted to the automatic drive time adjusting mode at S52, but instead the high-speed drive time is reset in the drive time adjusting mode at S44.

In the motor-driven screwdriver system 1, the high-speed drive time can be set automatically by the control unit 24 based on the tightening time in the screw tightening operation performed at the setting rotational speed in the above-described steps S30 to S38. In most cases, the high-speed drive time can be set to be an appropriate time by the above-described setting. Therefore, the operator need not repeat trial-and-error screw tightening operation using screws for testing many times in order to set the high-speed drive time. If the setting rotational speed is preset to the same speed as the low rotational speed used in the actual production line, the tightening torque will comply with standards on the production line. Therefore, even in the drive time setting mode, screws can be tightened to an actual product as a part of an assembling operation for the product without the need to use screws and a to-be-fastened object which are prepared specially for setting purposes. In other words, it is unnecessary to perform a screw tightening operation only for setting purposes.

Further, the motor-driven screwdriver system 1 is configured such that the high-speed drive time can be adjusted in the drive time adjusting mode (S44) when the high-speed drive time set based on the above-described initial setting time is not appropriate or does not fit the operator's operational feeling. In the drive time adjusting mode, the operator can adjust the high-speed drive time intuitively while performing an actual screw tightening operation; therefore, the adjustment can be made easily and rapidly.

Although in the foregoing embodiment, the motor-driven screwdriver system 1, which is a tool for tightening screws, has been explained as one embodiment of the threaded member tightening tool of the present invention, it should be noted that the present invention may also be applied to other threaded member tightening tools for tightening other threaded members, e.g. nuts. Further, although the above-described motor-driven screwdriver system 1 is configured to measure the tightening time by detecting the completion of tightening of a screw by using the Hall element 26 or the electric current sensor 28 as a tightening detecting unit, the tightening time may be measured by other methods. For example, the tightening time may be measured by the operator himself or herself. Further, although the initial setting time is calculated by the control unit 24 in the foregoing embodiment, the initial setting time may be calculated from the above formula 1 by another external device and input to the motor-driven screwdriver system 1. The arrangement may also be such that the operator himself or herself calculates and inputs the initial setting time to the motor-driven screwdriver system 1.

Further, although the foregoing embodiment uses the dial 34 as an operation input device for inputting the adjusting time in the drive time adjusting mode, it is also possible to use another type of operation input device comprising, for example, two buttons, in which pressing one of the two buttons increases the adjusting time, and pressing the other button decreases the adjusting time. The adjusting time can also be input by an input signal from another external device. Further, the motor-driven screwdriver body and the controller may be integrated together as one unit. It should be noted that the specific values of the high rotational speed, the low rotational speed, the arbitrary constant, etc. shown in the foregoing embodiment are for illustrative purposes only and therefore can be set properly at will.

LIST OF REFERENCE SIGNS

Motor-driven screwdriver system 1; cable 2; motor-driven screwdriver body 10; housing 12; screwdriver bit 14; bit holder 16; trigger lever 18; connection terminal 20; electric motor 22; control unit 24; Hall element 26; electric current sensor 28; controller 30; display unit 32; dial 34; connection terminal 36; control unit 38.

The invention claimed is:

1. A threaded member tightening tool comprising:

an electric motor for rotationally driving a threaded member engaging unit engageable with a threaded member;

a control unit drive-controlling the electric motor; and a tightening detecting unit detecting that a threaded member has been tightened to an object to be fastened;

the control unit being configured to control the electric motor so that the threaded member engaging unit is first rotationally driven at a predetermined high rotational speed only for a high-speed drive time and thereafter rotationally driven at a predetermined low rotational speed lower than the high rotational speed;

wherein the control unit drive-controls the electric motor so that the threaded member engaging unit is rotationally driven at a setting rotational speed, measures a tightening time required until the tightening detecting unit detects that a threaded member engaged with the threaded member engaging unit has been tightened to an object to be fastened, calculates an initial setting time by multiplying the tightening time by a predetermined positive value less than 1 and a value obtained by dividing the setting rotational speed by the high rotational speed, and sets the high-speed drive time to the initial setting time.

2. The threaded member tightening tool of claim 1, further comprising:

an operation input device transmitting a setting time changing signal to the control unit;

the control unit being configured to calculate, when receiving the setting time changing signal, a first resetting time by adding or subtracting a predetermined adjusting time to or from the high-speed drive time, and to reset the high-speed drive time to the first resetting time.

3. The threaded member tightening tool of claim 1, further comprising:

an operation input device transmitting a setting time changing signal to the control unit;

the control unit being configured to calculate, when receiving the setting time changing signal, a first resetting time by increasing or decreasing the high-speed drive time by an amount corresponding to a predetermined proportion of the high-speed drive time, and to reset the high-speed drive time to the first resetting time.

4. The threaded member tightening tool of claim 1, wherein the control unit measures a low-speed drive time required from when the high-speed drive time has elapsed until the tightening detecting unit detects that a threaded member has been tightened to an object to be fastened, calculates a first resetting time by adding or subtracting an adjusting time to or from the high-speed drive time, the adjusting time being obtained by multiplying the low-speed drive time by a predetermined positive value less than 1 and a value obtained by dividing the low rotational speed by the high rotational speed, and resets the high-speed drive time to the first resetting time.

5. The threaded member tightening tool of claim 1, wherein the control unit calculates a second resetting time by subtracting a predetermined adjusting time from the high-speed drive time when the tightening detecting unit detects that a threaded member has been tightened to an object to be fastened before the high-speed drive time has elapsed, and resets the high-speed drive time to the second resetting time.

6. The threaded member tightening tool of claim 1, wherein when the tightening detecting unit detects that a threaded member has been tightened to an object to be fastened before the high-speed drive time has elapsed, the control unit calculates a second resetting time by multiplying the high-speed drive time by a predetermined positive value less than 1, and resets the high-speed drive time to the second resetting time.

7. A drive time setting method of setting a high-speed drive time for a threaded member tightening tool, the threaded member tightening tool having an electric motor for rotationally driving a threaded member engaging unit engageable with a threaded member, and a control unit drive-controlling the electric motor, the control unit being configured to control the electric motor so that the threaded member engaging unit is first rotationally driven at a predetermined high rotational speed only for a high-speed drive time and thereafter rotationally driven at a predetermined low rotational speed lower than the high rotational speed;

the drive time setting method comprising:

the step of rotationally driving the threaded member engaging unit at a setting rotational speed and of measuring a tightening time required until a threaded member engaged with the threaded member engaging unit has been tightened to an object to be fastened;

the step of calculating an initial setting time by multiplying the tightening time by a predetermined positive value less than 1 and a value obtained by dividing the setting rotational speed by the high rotational speed; and the step of setting the high-speed drive time to the initial setting time.

8. The drive time setting method of claim 7, further comprising, following the step of setting the high-speed drive time to the initial setting time:

the step of calculating a first resetting time by adding or subtracting a predetermined adjusting time to or from the high-speed drive time; and the step of resetting the high-speed drive time to the first resetting time.

9. The drive time setting method of claim 7, further comprising, following the step of setting the high-speed drive time to the initial setting time:

the step of calculating a first resetting time by increasing or decreasing the high-speed drive time by an amount corresponding to a predetermined proportion of the high-speed drive time; and the step of resetting the high-speed drive time to the first resetting time.

10. The drive time setting method of claim 7, further comprising, following the step of setting the high-speed drive time to the initial setting time:

the step of, while performing a threaded member tightening operation with the threaded member tightening tool, measuring a low-speed drive time required from when the high-speed drive time has elapsed until a threaded member has been tightened to an object to be fastened;

the step of calculating a first resetting time by adding or subtracting an adjusting time to or from the high-speed drive time, the adjusting time being obtained by multiplying the low-speed drive time by a predetermined positive value less than 1 and a value obtained by dividing the low rotational speed by the high rotational speed; and the step of resetting the high-speed drive time to the first resetting time.

11. The drive time setting method of claim 7, further comprising:

the step of, when a threaded member has been tightened to an object to be fastened before the high-speed drive time has elapsed during a threaded member tightening operation performed with the threaded member tightening tool, calculating a second resetting time by subtracting a predetermined adjusting time from the high-speed drive time; and the step of resetting the high-speed drive time to the second resetting time.

12. The drive time setting method of claim 7, further comprising:

the step of, when a threaded member has been tightened to an object to be fastened before the high-speed drive time has elapsed during a threaded member tightening operation performed with the threaded member tightening tool, calculating a second resetting time by multiplying the high-speed drive time by a predetermined positive value less than 1; and the step of resetting the high-speed drive time to the second resetting time.

* * * * *